US010651632B2

(12) United States Patent
Kimura

(10) Patent No.: US 10,651,632 B2
(45) Date of Patent: May 12, 2020

(54) SPARK PLUG

(71) Applicant: NGK SPARK PLUG CO., LTD., Nagoya-shi, Aichi (JP)

(72) Inventor: Junji Kimura, Nagoya (JP)

(73) Assignee: NGK SPARK PLUG CO., LTD., Nagoya-shi (JP)

( * ) Notice: Subject to any disclaimer, the term of this patent is extended or adjusted under 35 U.S.C. 154(b) by 0 days.

(21) Appl. No.: 16/504,541

(22) Filed: Jul. 8, 2019

(65) Prior Publication Data

US 2020/0021084 A1 Jan. 16, 2020

(30) Foreign Application Priority Data

Jul. 11, 2018 (JP) ..... 2018-131446

(51) Int. Cl.
*H01T 13/39* (2006.01)

(52) U.S. Cl.
CPC ..... *H01T 13/39* (2013.01)

(58) Field of Classification Search
CPC ..... H01T 13/20; H01T 13/39
See application file for complete search history.

(56) References Cited

U.S. PATENT DOCUMENTS 6,215,235 B1 * 4/2001 Osamura ..... H01T 13/39 313/141
2006/0066195 A1 * 3/2006 Suzuki ..... H01T 13/39 313/141
2010/0253203 A1 * 10/2010 Suzuki ..... H01T 13/39 313/141
2014/0292179 A1 * 10/2014 Katsuraya ..... F02P 3/01 313/141
2016/0268781 A1 * 9/2016 Kato ..... H01T 21/02
2017/0033540 A1 * 2/2017 Suzuki ..... H01T 13/39
2017/0125981 A1 * 5/2017 Suzuki ..... H01T 13/20
2018/0351331 A1 * 12/2018 Hasegawa ..... H01T 13/20

FOREIGN PATENT DOCUMENTS

JP 2017-228430 A 12/2017

* cited by examiner

*Primary Examiner* — Donald L Raleigh
(74) *Attorney, Agent, or Firm* — Kusner and Jaffe

(57) ABSTRACT

A spark plug includes a tip extending in a first direction and an electrode base metal having an extending portion extending in the first direction and connected to the tip through a fusion zone. In a section taken along the first direction and containing a center axis of the tip, in a case where two ends of the interface between the extending portion and the fusion zone are located at the same position with respect to the first direction, the linear distance between the ends is denoted by A, or, in a case where one end is located forward of the other end, the distance from the one end to an intersection between a straight line passing the one end and extending perpendicularly to the center axis and the outline of the fusion zone is denoted by A. The interface length B satisfies a relational expression B/A≥1.2.

8 Claims, 5 Drawing Sheets

SPARK PLUG

RELATED APPLICATIONS

This application claims the benefit of Japanese Patent Application No. 2018-131446, filed Jul. 11, 2018, the entire content of which is incorporated herein by reference.

FIELD OF THE INVENTION

The present invention relates to a spark plug, particularly, to a spark plug in which a tip is joined to an electrode base metal.

BACKGROUND OF THE INVENTION

There is known a spark plug in which a tip is connected to an electrode base metal through a fusion zone (see, for example, Japanese Patent Application Laid-Open (kokai) No. 2017-228430).

A spark plug of this type is required to employ a technique for restraining separation at the interface between an electrode base metal and a fusion zone so as to prevent detachment of a tip from the electrode base metal even in the event of development of cracking from an end of the interface between the electrode base metal and the fusion zone.

The present invention has been conceived to meet the above requirement. An advantage of the invention is a spark plug capable of restraining separation at the interface between an electrode base metal and a fusion zone.

SUMMARY OF THE INVENTION

In accordance with a first aspect of the present invention there is provided a spark plug comprised of a tip extending in a first direction directed from a rear end side to a forward end side, and an electrode base metal having an extending portion which extends in the first direction and whose forward end portion is connected to a rear end portion of the tip through a fusion zone. In a section taken along the first direction and containing a center axis of the tip extending in the first direction, A and B satisfy a relational expression $B/A \geq 1.2$, where, in a case where two ends of a line indicative of an interface between the extending portion and the fusion zone are located at the same position with respect to the first direction, A is a linear distance between the two ends, or, in a case where one of the two ends is located forward of the other end with respect to the first direction, A is a distance on a straight line passing the one end and extending perpendicularly to the center axis, from the one end to an intersection between the straight line and an outline of the fusion zone on a side toward the other end, and B is a length of the line indicative of the interface.

According to the spark plug described above, in a section containing the center axis of the tip, the length B of the line indicative of the interface between the electrode base metal and the fusion zone and the length A of the line segment perpendicular to the center axis and containing the ends of the interface satisfy the relational expression $B/A \geq 1.2$. Thus, cracking is less likely to develop from one end to the other end of the interface between the electrode base metal and the fusion zone, whereby separation at the interface can be restrained.

According to a second aspect of the present invention there is provided a spark plug as described above wherein, the line indicative of the interface has at least one salient projecting toward the forward end side. Since the salient(s) can reduce the degree of development of cracking from one end or the other end along a direction perpendicular to the center axis, the effect of the first aspect of the invention can be achieved, and separation at the interface between the electrode base metal and the fusion zone can be further restrained.

According to a third aspect of the present invention there is provided a spark plug as described above wherein, a first vertex located most forward of vertexes of the salients is present in a first area of the line indicative of the interface located toward the one end with respect to the center axis or a second area of the line indicative of the interface located toward the other end with respect to the center axis. Thus, as compared with the case where the first vertex is present on the center axis, the degree of development of cracking from one end or the other end along a direction perpendicular to the center axis can be further reduced. As a result, the effect of the second aspect of the invention can be achieved, and separation at the interface between the electrode base metal and the fusion zone can be further restrained.

According to a fourth aspect of the present invention there is provided a spark plug as described above wherein, the line indicative of the interface has two or more salients. In the first area or the second area in which the first vertex is absent, a second vertex located at the same position as that of the first vertex with respect to the first direction or located second most forward next to the first vertex is present. By virtue of the second vertex, the degree of development of cracking from one end or the other end along a direction perpendicular to the center axis can be reduced. Further, as compared with the case where the second vertex is present on the center axis, the degree of development of cracking from one end or the other end along a direction perpendicular to the center axis can be further reduced. As a result, the effect of the third aspect of the invention can be achieved, and separation at the interface can be further restrained.

According to a fifth aspect of the present invention there is provided a spark plug as described above wherein, in any section containing the center axis, the relational expression $B/A \geq 1.2$ is satisfied. Therefore, the effect of any one of the aforementioned aspects of the invention can be achieved, and separation at the interface between the electrode base metal and the fusion zone can be further restrained.

DETAILED DESCRIPTION OF THE INVENTION

Figure 1:
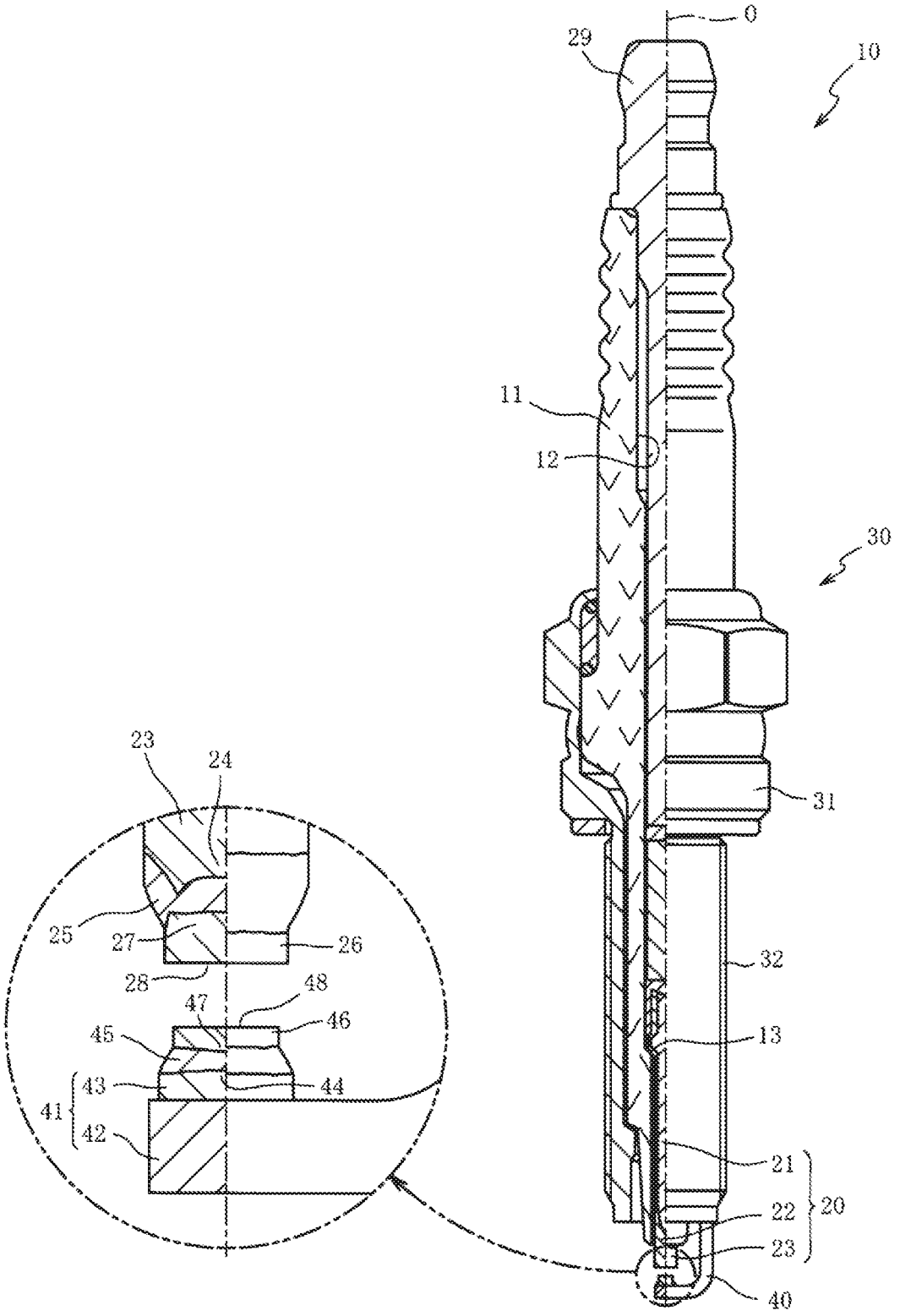
FIG. 1 is a half sectional view of a spark plug according to a first embodiment.

Preferred embodiments of the present invention will next be described with reference to the appended drawings. FIG. 1 is a half sectional view, bordered with an axial line O, of a spark plug 10 according to a first embodiment. In FIG. 1, the lower side is called the forward end side of the spark plug 10, and the upper side is called the rear end side of the spark plug 10. As shown in FIG. 1, the spark plug 10 has a center electrode 20 and a ground electrode 40.

An insulator 11 is an approximately cylindrical member having an axial hole 12 along the axial line O and is formed of ceramic, such as alumina, excellent in mechanical characteristics and insulating performance at high temperature. The insulator 11 has a rearward-facing surface 13, or an annular surface facing rearward, formed on the forward end side of the inner circumferential surface of the axial hole 12. The rearward-facing surface 13 reduces in diameter toward the forward end side.

The center electrode 20 is a rodlike member seated on the rearward-facing surface 13. The forward end of the center electrode 20 projects forward from the forward end of the insulator 11. The center electrode 20 is configured such that a core 21 containing copper as a main component is covered with a closed-bottomed cylindrical electrode base metal 22. The electrode base metal 22 has a chemical composition containing Ni in an amount of 50 wt. % or more. The core 21 can be omitted.

The electrode base metal 22 has an extending portion 23 whose forward end portion 24 projects from the forward end of the insulator 11. The extending portion 23 is a portion of the electrode base metal 22 and is formed into a circular columnar shape extending in the axial direction. A rear end portion 27 of a disk-like tip 26 is connected to the forward end portion 24 of the extending portion 23 through a fusion zone 25. In the present embodiment, the tip 26 has a chemical composition containing one or more noble metals of Pt, Rh, Ir, Ru, etc., in an amount of 50 wt. % or more. A discharge surface 28 of the tip 26 faces the ground electrode 40. The center electrode 20 is electrically connected to a metal terminal 29 in the axial hole 12.

The metal terminal 29 is a rodlike member to be connected to a high-voltage cable (not shown) and is formed of an electrically conductive metal material (e.g., low-carbon steel). The metal terminal 29 is fixed at the rear end side of the insulator 11 while a forward end side thereof is inserted into the axial hole 12.

A metallic shell 30 is fixed to the outer circumference of a forward end portion of the insulator 11 by means of crimping. The metallic shell 30 is an approximately cylindrical member formed of an electrically conductive metal material (e.g., low-carbon steel). The metallic shell 30 has a seat portion 31 projecting radially outward in a collar-like form and a screw portion 32 formed on an outer circumferential surface located forward of the seat portion 31. The metallic shell 30 is fixed by screwing the screw portion 32 into a threaded hole (not shown) of an engine (cylinder head). The ground electrode 40 is connected to a forward end portion of the metallic shell 30.

The ground electrode 40 is a rodlike member formed of an electrically conductive metal material. The ground electrode 40 has an electrode base metal 41 joined to the metallic shell 30, and a tip 46. The electrode base metal 41 has a support portion 42 whose end portion is joined to the metallic shell 30, and an extending portion 43 joined to the support portion 42 by resistance welding, laser welding, or the like. The support portion 42 and the extending portion 43 have a chemical composition containing Ni in an amount of 50 wt. % or more.

The extending portion 43 is formed into a circular columnar shape extending in the axial direction. A rear end portion 47 of a disk-like tip 46 is connected to a forward end portion 44 of the extending portion 43 through a fusion zone 45. In the present embodiment, the tip 46 has a chemical composition containing one or more noble metals of Pt, Rh, Ir, Ru, etc., in an amount of 50 wt. % or more. A discharge surface 48 of the tip 46 faces the center electrode 20. A spark gap is formed between the discharge surface 48 of the tip 46 and the center electrode 20.

Notably, for conformity of the forward end side and the rear end side of the extending portion 43 and the tip 46 of the ground electrode 40 with the forward end side and the rear end side of the extending portion 23 and the tip 26 of the center electrode 20, differently from the forward end side and the rear end side of the spark plug 10, a portion of the extending portion 43 joined to the support portion 42 is referred to as a rear end, and the discharge surface 48 of the tip 46 is referred to as a forward end.

Figure 2:
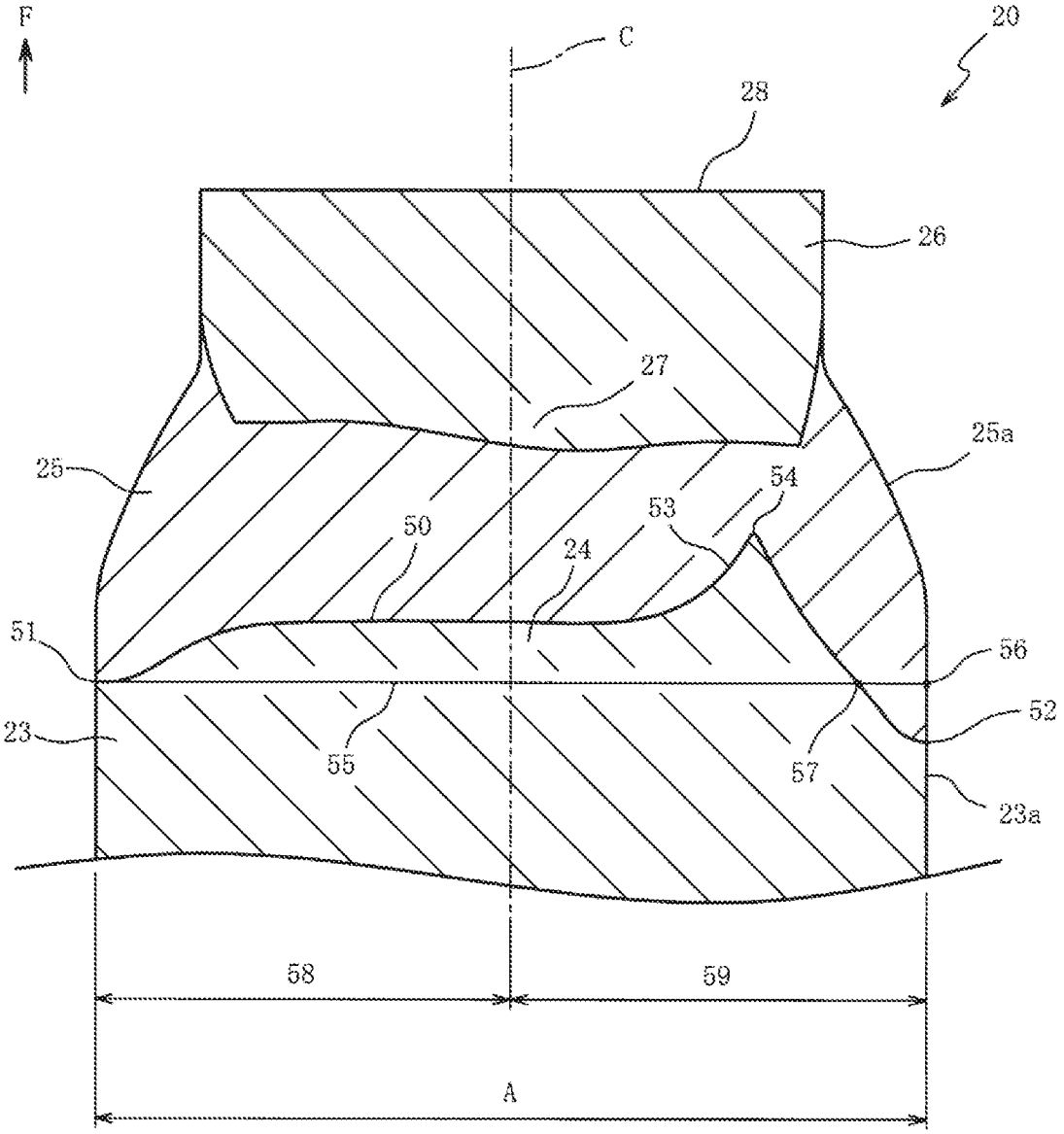
FIG. 2 is a sectional view of a center electrode which contains the center axis of a tip.

FIG. 2 is a sectional view of the center electrode 20 containing the center axis C of the tip 26. The center axis C passes the centroid of the discharge surface 28 of the tip 26 and extends in the direction in which the extending portion 23 extends. The arrow F indicates a first direction directed from the rear end portion 27 to the discharge surface 28 of the tip 26. In the present embodiment, the center axis C coincides with the axial line O (see FIG. 1) of the spark plug 10. The tip 26 is connected to the extending portion 23 through the fusion zone 25. In the fusion zone 25, the tip 26 and the extending portion 23 are fused together. The line indicative of an interface 50 between the fusion zone 25 and the extending portion 23 is divided into a first area 58 located on a side toward one end 51 of the interface 50 with respect to the center axis C and a second area 59 located on a side toward the other end 52 of the interface 50 with respect to the center axis C.

In the present embodiment, the fusion zone 25 is formed as a result of laser welding. The one end 51 and the other end 52 (two ends of the interface 50) at which the line indicative of the interface 50 and an outline 23*a* of the extending portion 23 intersect each other are such that the one end 51 is located forward of the other end 52 with respect to the direction of the arrow F (first direction). In this case, the relational expression $B/A \geq 1.2$ is satisfied, where A is a distance on a straight line 55 passing the one end 51 and extending perpendicularly to the center axis C, from an intersection 56 between the straight line 55 and an outline 25*a* of the fusion zone 25 to the one end 51, and B is the length of the interface 50 (length along the interface 50 from the one end 51 to the other end 52).

Notably, the straight line 55 intersects with the contour of the fusion zone 25 also at an intersection 57 in addition to the intersection 56. However, an intersection used to obtain the distance A from the one end 51 is the intersection 56 with the outline 25*a* indicative of an externally visible shape of the fusion zone 25, not the intersection 57 visible only on a cut section (invisible from outside). This is for the following reason: since the length B is along the interface 50 from the intersection (the other end 52) between the outline 23*a* of the extending portion 23 and the interface 50 to the one end 51, for conformity with the length B, the intersection 56 between the straight line 55 and the outline 25*a* is used for obtaining the distance A.

The length B can be obtained as follows: a section containing the center axis C is image-captured; 100 equally dividing points of the interface 50 (obtained by projecting equally dividing points of the straight line 55 onto the interface 50) are plotted by image processing; then, linear distances between the adjacent points are totaled.

Since the spark plug 10 is repeatedly heated and cooled within an engine, thermal stress is apt to cause generation of a crack in the interface 50 between the extending portion 23 and the fusion zone 25. Cracking develops from the one end 51 and the other end 52 of the interface 50 because of contact with high-temperature combustion gas. In the spark plug 10, in a section containing the center axis C of the tip 26, since A and B satisfy the relational expression B/A≥1.2, where B is the length of the interface 50, and A is the length of a line segment containing the one end 51 of the interface 50 and extending perpendicularly to the center axis C, cracking is unlikely to develop from the one end 51 to the other end 52 of the interface 50 or from the other end 52 to the one end 51. Therefore, there can be restrained fracture of the interface 50 which could otherwise result from development of cracking.

The interface 50 has a salient 53 projecting toward the forward end side. A first vertex 54 located most forward on the salient 53 is located at a position other than those of the one end 51 and the other end 52 of the interface 50. Since the first vertex 54 is present on the salient 53, the direction of inclination of the salient 53 with respect to the center axis C changes at the first vertex 54. As a result, the salient 53 can reduce the degree of development of cracking in a direction perpendicular to the center axis C. Therefore, separation at the interface 50 can be further restrained.

The first vertex 54 of the salient 53 is present in the second area 59 of the interface 50 located toward the other end 52 with respect to the center axis C. As a result, as compared with the case where the first vertex 54 is present on the center axis C, the degree of development of cracking from the other end 52 in a direction perpendicular to the center axis C can be further reduced. As a result, as compared with the case where the first vertex 54 is present on the center axis C, separation at the interface 50 can be further restrained.

Notably, more preferably, the condition of B/A≥1.2 that the interface 50 of the fusion zone 25 satisfies holds true in any section which contains the center axis C. Any section which contains the center axis C can be obtained by image processing. The method is as follows. First, the center electrode 20 is ground little by little perpendicularly to the center axis C, and the resultant section is repeatedly image-captured. The resultant images are processed to obtain a three-dimensional structure of the interface 50. Next, the length B of the interface 50 and the distance A are measured in any section containing the center axis C of the obtained three-dimensional structure, whereby whether or not the relational expression B/A≥1.2 is satisfied in the section containing the center axis C can be judged. Through satisfaction of the relational expression B/A≥1.2 in any section containing the center axis C, separation at the interface 50 can be further restrained.

Figure 3:
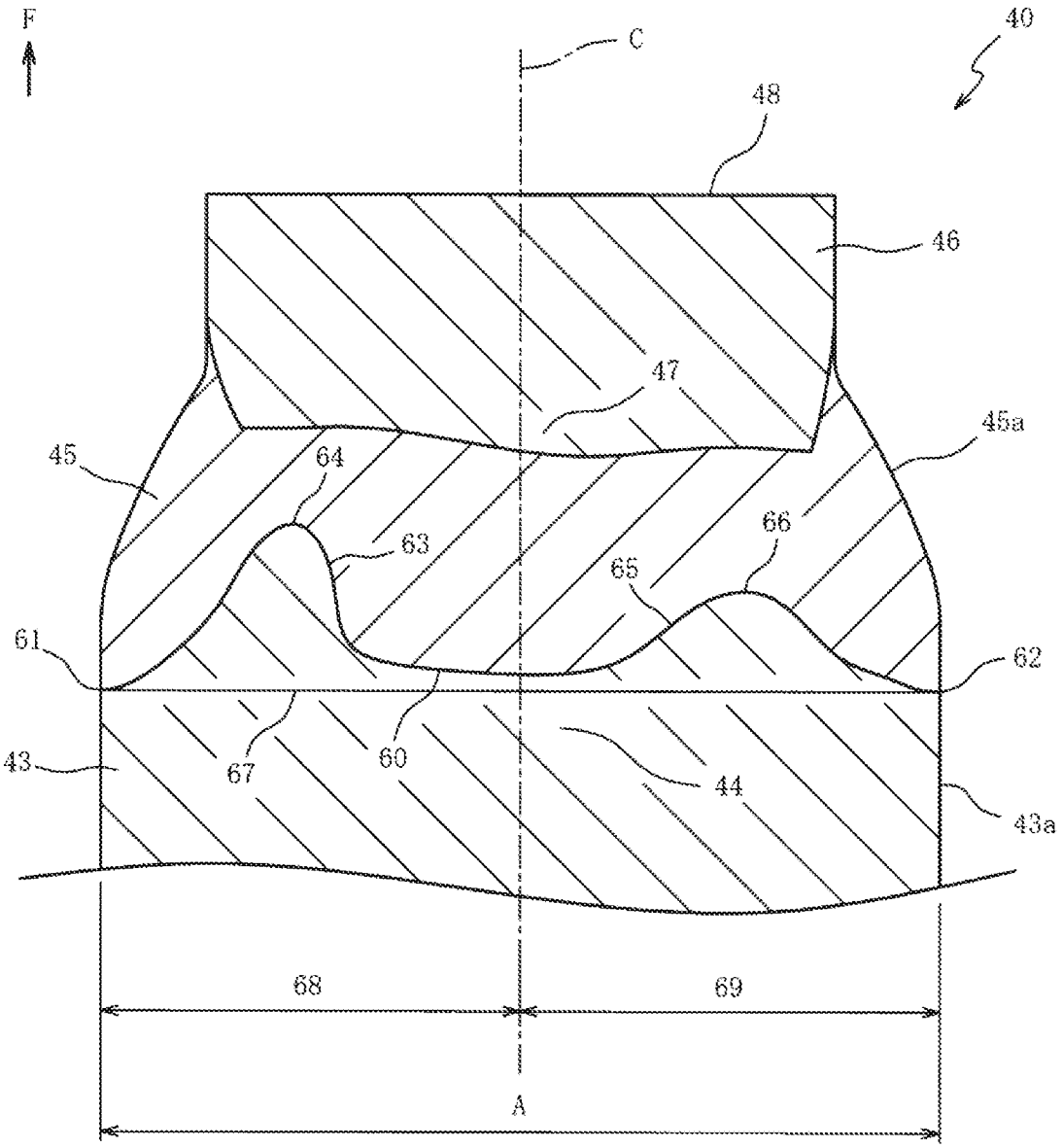
FIG. 3 is a sectional view of a ground electrode which contains the center axis of a tip.

FIG. 3 is a sectional view of the ground electrode 40 containing the center axis C of the tip 46. The center axis C passes the centroid of the discharge surface 48 of the tip 46 and extends in the direction in which the extending portion 43 extends. The arrow F indicates a first direction directed from the rear end portion 47 to the discharge surface 48 of the tip 46. In the present embodiment, the center axis C coincides with the axial line O (see FIG. 1) of the spark plug 10. The tip 46 is connected to the extending portion 43 through the fusion zone 45. The line indicative of an interface 60 between the fusion zone 45 and the extending portion 43 is divided into a first area 68 located on a side toward one end 61 of the interface 60 with respect to the center axis C and a second area 69 located on a side toward the other end 62 of the interface 60 with respect to the center axis C.

In the present embodiment, the fusion zone 45 is formed as a result of laser welding. The one end 61 and the other end 62 (two ends of the interface 60) at which the line indicative of the interface 60 and outlines 43*a* and 45*a* of the extending portion 43 and the fusion zone 45 intersect each other are located at the same position with respect to the direction of the arrow F (first direction). In this case, the linear distance A (length of a line segment) between the one end 61 and the other end 62 and the length B of the interface 60 satisfy the relational expression B/A≥1.2. The length B of the interface 60 is obtained in a manner similar to that employed for obtaining the length B of the interface 50. Through satisfaction of the relational expression B/A≥1.2, cracking from the one end 61 to the other end 62 of the interface 60 or from the other end 62 to the one end 61 is unlikely to develop. Therefore, there can be restrained separation at the interface 60 which could otherwise result from development of cracking.

The interface 60 has a plurality of salients 63 and 65 projecting toward the forward end side. A first vertex 64 located most forward on the salient 63 is present in the first area 68 of the interface 60 (excluding the one end 61 and the center axis C) located toward the one end 61 with respect to the center axis C. A second vertex 66 located most forward on the salient 65 is present in the second area 69 of the interface 60 (excluding the other end 62 and the center axis C) located toward the other end 62 with respect to the center axis C. The second vertex 66 is located second most forward next to the first vertex 64 with respect to the first direction (direction of the arrow F).

Since the second vertex 66 is present on the salient 65, the direction of inclination of the salient 65 with respect to the center axis C changes at the second vertex 66. In addition to the first vertex 64, the second vertex 66 can reduce the degree of development of cracking from the other end 62 toward the one end 61 of the interface 60 in a direction perpendicular to the center axis C. Therefore, the action and the effect regarding the interface 50 of the fusion zone 25 of the center electrode 20 can be achieved, and separation at the interface 60 can be further restrained.

Figure 4:
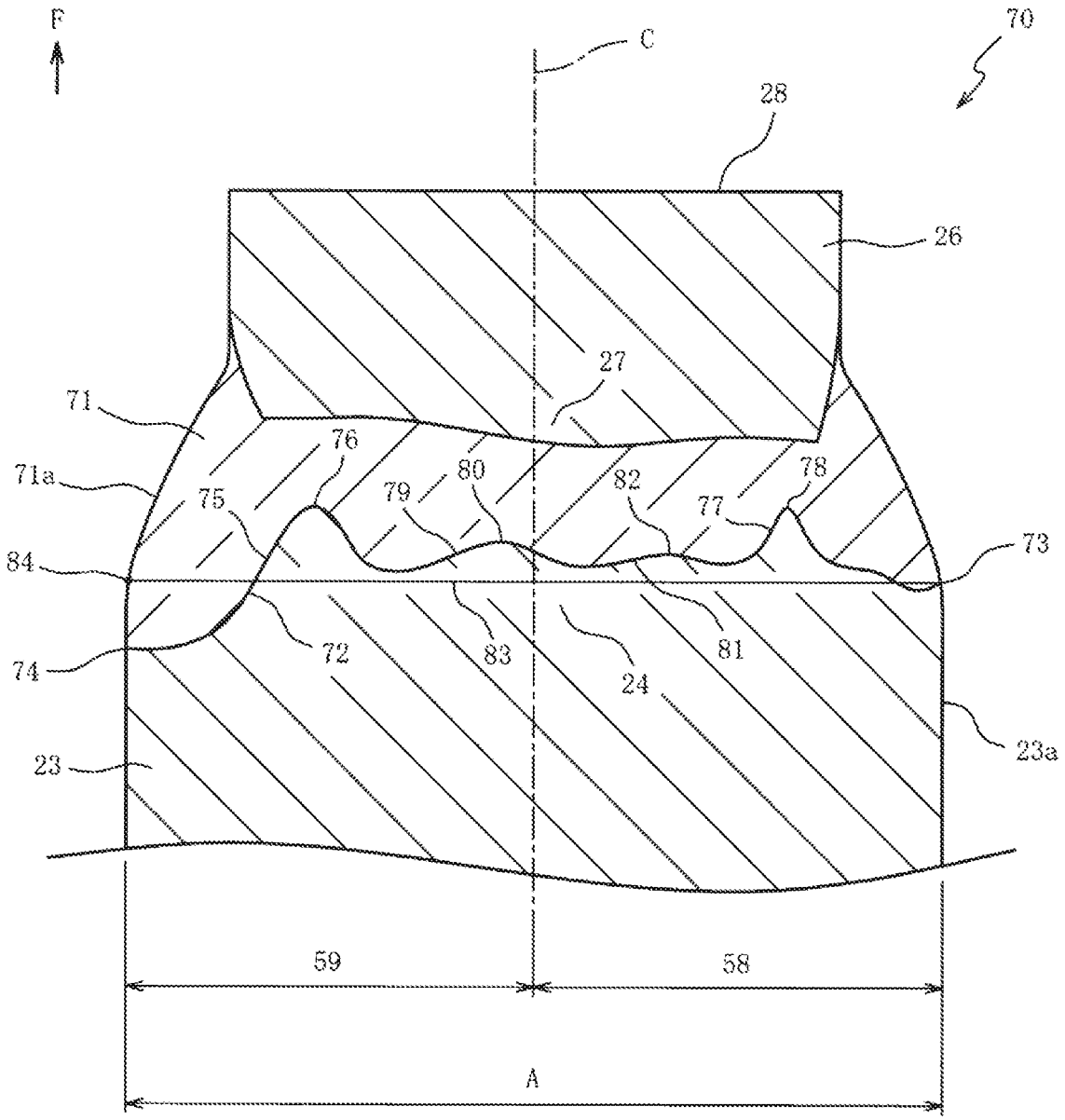
FIG. 4 is a sectional view of a center electrode which contains the center axis of a tip in a spark plug according to a second embodiment.

A second embodiment will next be described with reference to FIG. 4. The first embodiment has been described while referring to the interfaces 50 and 60 having one or two salients. By contrast, the second embodiment will be described while referring to an interface 72 having a greater number of salients. Notably, like structural features of the first and second embodiments are denoted by like reference numerals, and repeated description thereof is omitted. FIG. 4 is a sectional view of a center electrode 70 which contains the center axis C of the tip 26 in a spark plug according to the second embodiment.

The tip 26 is connected to the extending portion 23 through a fusion zone 71. In the present embodiment also, the fusion zone 71 is formed as a result of laser welding. One end 73 and the other end 74 (two ends of the interface 72) at which the line indicative of the interface 72 between the fusion zone 71 and the extending portion 23 and the outline 23*a* of the extending portion 23 intersect each other are such that the one end 73 is located forward of the other end 74 with respect to the direction of the arrow F (first direction). In this case, the relational expression B/A≥1.2 is satisfied, where A is a distance on a straight line 83 passing the one end 73 and extending perpendicularly to the center axis C, from an intersection 84 between the straight line 83 and an outline 71*a* of the fusion zone 71 to the one end 73, and B is the length of the interface 72 (length along the interface 72 from the one end 73 to the other end 74).

The interface 72 has a plurality of salients 75, 77, 79, and 81 projecting toward the forward end side. A first vertex 76 located most forward on the salient 75 is located at the same position with respect to the first direction (direction of the arrow F) as that of a second vertex 78 located most forward on the salient 77. A third vertex 80 located most forward on the salient 79 and a fourth vertex 82 located most forward on the salient 81 are located rearward of the first vertex 76 and the second vertex 78 with respect to the first direction (direction of the arrow F). The second vertex 78 is present in the first area 58 of the interface 72 (excluding the one end 73 and the center axis C) located toward the one end 73 with respect to the center axis C. The first vertex 76 is present in the second area 59 of the interface 72 (excluding the other end 74 and the center axis C) located toward the other end 74 with respect to the center axis C. According to the present spark plug, an action and an effect similar to those yielded by the ground electrode 40 described in the first embodiment can be yielded.

EXAMPLE

Figure 5A:
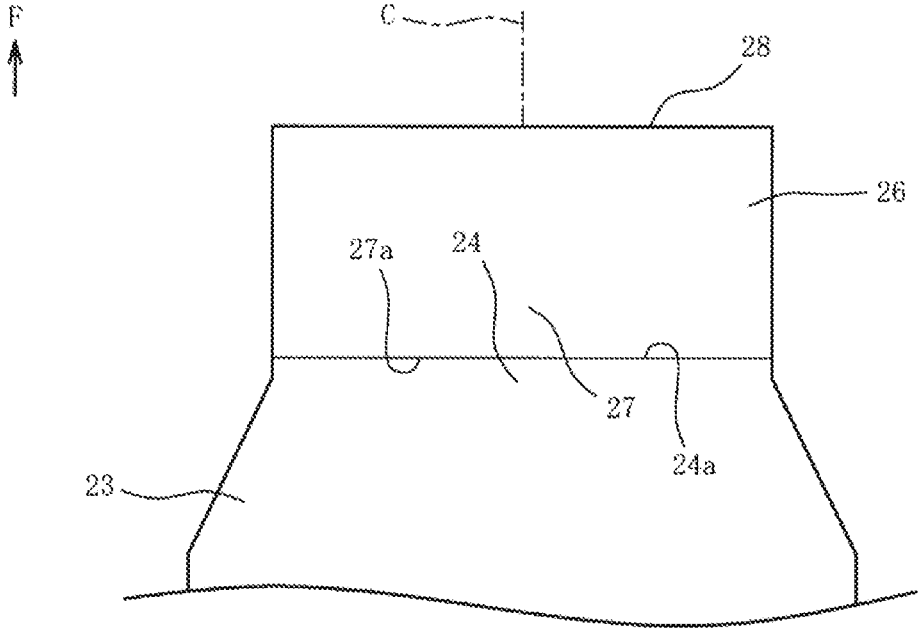
FIG. 5A is a side view of an electrode base metal and a tip.

The present invention will be described further in detail on the basis of an example; however, the present invention is not limited to the example. FIG. 5A is a side view showing an electrode base metal (extending portion 23) of a center electrode and the tip 26 used for preparing samples of a spark plug in the example.

As shown in FIG. 5A, the extending portion 23 has a truncated-cone shape, and an end surface 24*a* of the forward end portion 24 has a circular shape. The extending portion 23 is formed of a Ni alloy (NCF601). The tip 26 is formed of an Ir alloy (Ir: 68 wt. %; Ru: 11 wt. %; Rh: 20 wt. %; and Ni: 1 wt. %) and has a circular columnar shape. An end surface 27*a* of the rear end portion 27 of the tip 26 opposite the discharge surface 28 has a circular shape.

With the end surface 27*a* of the tip 26 in contact with the end surface 24*a* of the extending portion 23, the workpiece was rotated about the center axis C, and the boundary between the tip 26 and the extending portion 23 was irradiated with a laser beam emitted from the working head of a laser welder (not shown). Various samples were prepared such that their fusion zones contained a total content of Ir, Ru, and Rh (components of the tip 26) of 50 wt. % or more and contained approximately the same total content of Ir, Ru, and Rh, and were prepared in such a manner as to differ in B/A by changing the spot diameter of the laser beam, laser output, etc.

A durability test was performed for each of the prepared samples. In the durability test, a thermal cycle including 2-minute heat application to their tips 26, extending portions 23, and fusion zones by a gas burner and subsequent 1-minute radiational cooling was repeated by 1,000 times. During heating in each cycle, the temperature of the extending portion 23 reached 1,000° C. Each sample was cut to obtain a section containing the center axis C; the section was polished to prepare a polished surface; the polished surface was image-captured by use of a metallograph; and the image was measured through image processing for the length B of the interface between the fusion zone and the extending portion, the distance A, and the percentage (%) of the length of crack in a direction perpendicular to the center axis C to the distance A. The length B was obtained by totaling the linear distances between adjacent equally dividing points of 100 equally dividing points of the interface.

Figure 5B:
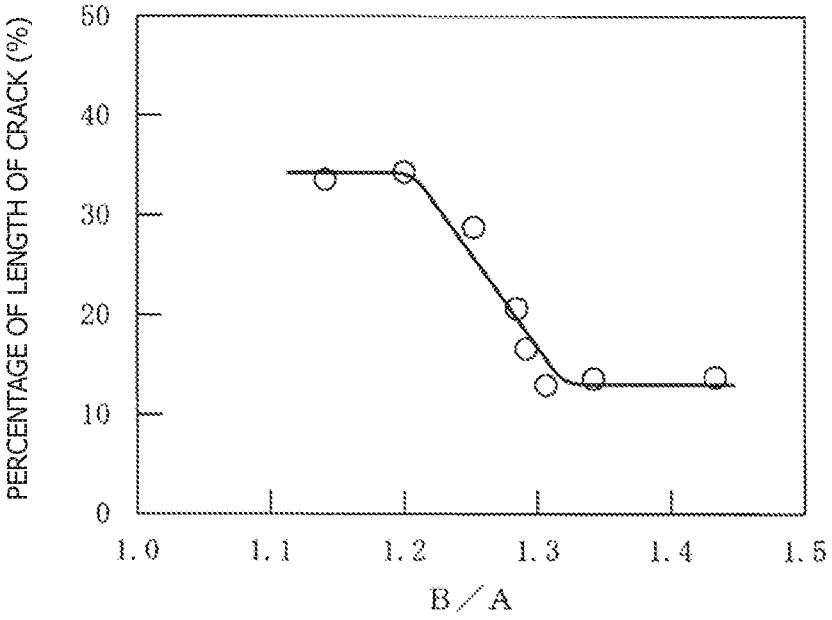
FIG. 5B is a correlation diagram showing the relation between B/A and the percentage of length of crack in an interface.

FIG. 5B is a correlation diagram showing the relation between B/A and the length of crack in the interface. The horizontal axis represents B/A, and the vertical axis represents the percentage (%) of length of crack. When the percentage (%) of the length of crack is 100, it means fracture of the interface. As shown in FIG. 5B, it was found that, at a B/A of 1.2 or more, the percentage (%) of length of crack markedly reduced. In some of the samples which satisfied the relational expression B/A≥1.2, the interface did not have a salient. According to the present example, it is apparent that satisfaction of the relational expression B/A≥1.2 can restrain fracture of the interface which could otherwise result from development of cracking.

The present example is of the case where the fusion zone contains the noble metal components of the tip 26 in an amount of 50 wt. % or more. However, even in a case where the fusion zone contained the noble metal components of the tip 26 in an amount of less than 50 wt. %, a tendency similar to that of the present example was observed when the relational expression B/A≥1.2 was satisfied.

While the present invention has been described with reference to the above embodiments, the present invention is not limited thereto, and various improvements and modifications are possible without departing from the spirit of the invention.

The above embodiments have been described while referring to the extending portions 23 and 43 and the tips 26 and 46 having a circular columnar shape or a truncated-cone shape; however, the present invention is not limited thereto. The extending portion and the tip may have a polygonal columnar shape.

The above embodiments have been described while referring to the case where the center axis C of the tips 26 and 46 coincides with the axial line O of the spark plug 10; however, the present invention is not limited thereto. The axial line O of the spark plug 10 and the center axis C of the tip may not coincide with each other.

Although not described in the above embodiments, a great effect is yielded in the case where the fusion zone 25, 45, or 71 contains the noble metal components of the tip 26 or 46 in an amount of 50 wt. % or more. This is for the following reason: since, as the amount of fusion of the tip 26 or 46 to form the fusion zone 25, 45, or 71 increases, the difference in linear expansion coefficient between the fusion zone 25, 45, or 71 and the extending portion 23 or 43 increases, thermal stress generated in the interface 50, 60, or 72 between the fusion zone 25, 45, or 71 and the extending portion 23 or 43 increases. Notably, even in the case where the amount of noble metal components of the tip 26 or 46 contained in the fusion zone is less than 50 wt. %, the working effect described in the sections of the embodiments is yielded, since thermal stress is still generated in the interface between the fusion zone and the extending portion because of presence of a difference in linear expansion coefficient therebetween.

The above embodiments have been described while referring to the interfaces 50, 60, 72 having the salients 53, 63, 65, 75, 77, 79, and 81; however, the present invention is not limited thereto. The presence of a salient(s) at the interface is not necessarily required. Even in the case where the interface has no salient, if the relational expression B/A≥1.2 is satisfied, stress generated in the interface is dispersed, whereby separation at the interface can be restrained.

The above embodiments have been described while referring to radiation of a laser beam for forming the fusion zones 25, 45, and 71; however, the present invention is not limited thereto. Of course, the fusion zone can be formed through radiation of other high-energy beams such as an electron beam.

The above embodiments have been described while referring to the case where both of the center electrode 20 and the ground electrode 40 satisfy the relational expression B/A≥1.2; however, the present invention is not limited thereto. It is sufficient that either one of the center electrode and the ground electrode satisfies the above relational expression. This is because, in the electrode which satisfies the above relational expression, separation at the interface can be restrained.

DESCRIPTION OF REFERENCE NUMERALS

10: spark plug
22, 41: electrode base metal
23, 43: extending portion
24, 44: forward end portion of extending portion
25, 45, 71: fusion zone
25*a*, 45*a*, 71*a*: outline
26, 46: tip
27, 47: rear end portion of tip
50, 60, 72: interface
51, 61, 73: one end (end)
52, 62, 74: the other end (end)
53, 63, 65, 75, 77, 79, 81: salient
54, 64, 76: first vertex
55, 67, 83: straight line
56, 84: intersection
58, 68: first area
59, 69: second area
66, 78: second vertex
A: distance
C: center axis Having described the invention, the following is claimed:

1. A spark plug comprising:

a tip extending in a first direction directed from a rear end side to a forward end side; and an electrode base metal having an extending portion which extends in the first direction and whose forward end portion is connected to a rear end portion of the tip through a fusion zone, wherein, in a section taken along the first direction and containing a center axis of the tip extending in the first direction, A and B satisfy a relational expression B/A≥1.2, where, in a case where two ends of a line indicative of an interface between the extending portion and the fusion zone are located at the same position with respect to the first direction, A is a linear distance between the two ends, or, in a case where one of the two ends is located forward of the other end with respect to the first direction, A is a distance on a straight line passing the one end and extending perpendicularly to the center axis, from the one end to an intersection between the straight line and an outline of the fusion zone on a side toward the other end, and B is a length of the line indicative of the interface.

2. A spark plug according to claim 1, wherein the line indicative of the interface has at least one salient projecting toward the forward end side.

3. A spark plug according to claim 2, wherein a first vertex located most forward of vertexes of the salients is present in a first area of the line indicative of the interface, the first area being located toward the one end with respect to the center axis, or a second area of the line indicative of the interface, the second area being located toward the other end with respect to the center axis.

4. A spark plug according to claim 3, wherein the line indicative of the interface has two or more salients, and in the first area or the second area in which the first vertex is absent, a second vertex located at the same position as that of the first vertex with respect to the first direction or located second most forward next to the first vertex with respect to the first direction is present.

5. A spark plug according to claim 1, wherein in any section containing the center axis, the relational expression B/A≥1.2 is satisfied.

6. A spark plug according to claim 2, wherein in any section containing the center axis, the relational expression B/A≥1.2 is satisfied.

7. A spark plug according to claim 3, wherein in any section containing the center axis, the relational expression B/A≥1.2 is satisfied.

8. A spark plug according to claim 4, wherein in any section containing the center axis, the relational expression B/A≥1.2 is satisfied.

* * * * *